US009995012B2

(12) United States Patent
Boumediene et al.

(10) Patent No.: US 9,995,012 B2
(45) Date of Patent: Jun. 12, 2018

(54) WHEELED SNOWPLOUGH SYSTEM

(71) Applicant: RIVAL, SOCIÉTÉ EN COMMANDITE, Montreal (CA)

(72) Inventors: Falah Boumediene, Quebec (CA); Pierre-Etienne Cote, Levis (CA)

(73) Assignee: RIVAL, SOCIÉTÉ EN COMMANDITE, Montréal (CA)

( * ) Notice: Subject to any disclaimer, the term of this patent is extended or adjusted under 35 U.S.C. 154(b) by 0 days. days.

(21) Appl. No.: 15/102,170

(22) PCT Filed: Dec. 8, 2014

(86) PCT No.: PCT/CA2014/051181

§ 371 (c)(1),
(2) Date: Jun. 6, 2016

(87) PCT Pub. No.: WO2015/081449

PCT Pub. Date: Jun. 11, 2015

(65) Prior Publication Data

US 2016/0312422 A1 Oct. 27, 2016

Related U.S. Application Data

(60) Provisional application No. 61/912,732, filed on Dec. 6, 2013.

(51) Int. Cl.
*E01H 5/06* (2006.01)

(52) U.S. Cl.
CPC ..... *E01H 5/066* (2013.01); *E01H 5/06* (2013.01); *E01H 5/061* (2013.01); *E01H 5/067* (2013.01)

(58) Field of Classification Search
CPC .. E01H 5/04; E01H 5/06; E01H 5/066; E01H 5/063; E01H 1/056; E01H 5/067; E01H 5/061
USPC ..... 37/231, 234, 235, 236, 253, 266, 270, 37/271; 280/86.1; 172/452, 810, 811, 172/817, 819, 253, 247
See application file for complete search history.

(56) References Cited

U.S. PATENT DOCUMENTS

| | | | | |
|---|---|---|---|---|
| 2,094,515 A * | 9/1937 | Abbe | E01H 5/063 37/232 |
| 3,426,458 A | 2/1969 | Spitzer | |
| 3,793,752 A | 2/1974 | Snyder | |
| 4,259,794 A * | 4/1981 | Rath | E01H 5/061 37/232 |
| 4,821,436 A | 4/1989 | Slocum | |
| 4,905,387 A * | 3/1990 | Street | E01H 5/066 172/799.5 |

(Continued)

*Primary Examiner* — Robert E Pezzuto
(74) *Attorney, Agent, or Firm* — Norton Rose Fulbright Canada LLP

(57) ABSTRACT

A snowplough system of the type being releasably anchored to a front end of a vehicle comprises a plough blade. A vehicle interface is adapted to be releasably anchored to the vehicle. A snowplough interface is operatively connected to the vehicle interface and comprises a structure supporting the plough blade, the structure being movable to displace the plough blade between a ploughing position and a retracted position. A wheel unit is connected to at least one of the vehicle interface and the snowplough interface, and comprises at least one wheel located in front of a front axle of the vehicle, to support part of the weight of the plough blade when in the retracted position.

20 Claims, 11 Drawing Sheets

(56) References Cited

U.S. PATENT DOCUMENTS

| | | | | |
|---|---|---|---|---|
| 5,136,795 | A | 8/1992 | Rosenberg | |
| 5,485,690 | A * | 1/1996 | MacQueen | E01H 5/066 172/212 |
| 6,050,008 | A | 4/2000 | Doornek et al. | |
| 8,033,036 | B1 * | 10/2011 | Turnbull | E01H 5/066 37/270 |
| 8,732,989 | B1 * | 5/2014 | Turnbull | E01H 5/066 37/270 |

* cited by examiner $$Pw = \tan^{-1}\left(\frac{WB + X}{WB}\tan(A_1)\right)$$

WHEELED SNOWPLOUGH SYSTEM

CROSS-REFERENCE TO RELATED APPLICATION

The present application claims priority on U.S. Provisional Patent Application No. 61/912,732, filed in Dec. 6, 2013.

TECHNICAL FIELD

The present application relates to snowplough systems of the type attachable to a vehicle for seasonal use of a snowplough.

BACKGROUND OF THE ART

It is known to use vocational trucks in different configurations so as to maximize the use thereof, in light of the important capital investment associated with such trucks. Hence, a vocational truck may be dedicated to dump-truck use in the summer, and be equipped with a snowplough in the winter. However, due to transport regulations and safety reasons, a vocational truck must have given specifications so as to operate a snowplough system. Indeed, existing snowplough systems are commonly anchored to the front of the vehicle, and may be raised to a retracted position to facilitate vehicle displacement when not snowploughing. In this retracted position, the snowplough blade is in a cantilevered arrangement relative to the truck. The cantilevered arrangement of the snowplough blade substantially increases the load on the front axle of the truck.

Hence, it is common to have oversizing specifications for vehicle axles, in light of the contemplated vocational use of the truck as a snowplough. For example, it may be required that the front axle of a truck operating a snowplough be oversized. Such specifications may have an impact on the efficiency of the vocational truck, for instance when subsequently used as a dump-truck. This may have an impact on the efficiency of the truck when used as a dump-truck, because of inadequate load spread on the truck, vehicle overweight, non-optimal road behaviour of the truck, increased turn radius, etc.

Moreover, the snowplough configuration may limit the capacity of the vehicle in terms of additional weight it can support. As a result, a truck operating a snowplough system may be limited in its load carrying capacity. This may prove problematic, in that trucks with snowploughing vocation are ideally equipped with equipment for spreading abrasives on the road, and with a load of abrasives.

SUMMARY

It is therefore an aim of the present disclosure to provide a wheeled snowplough system that addresses issues associated with the prior art.

Therefore, in accordance with the present disclosure, there is provided: a snowplough system of the type being releasably anchored to a front end of a vehicle, the snowplough system comprising: a plough blade; a vehicle interface adapted to be releasably anchored to the vehicle; a snowplough interface operatively connected to the vehicle interface and comprising a structure supporting the plough blade, the structure being movable to displace the plough blade between a ploughing position and a retracted position; and a wheel unit connected to at least one of the vehicle interface and the snowplough interface, and comprising at least one wheel located in front of a front axle of the vehicle, to support part of the weight of the plough blade when in the retracted position.

Further in accordance with the present disclosure, the structure of the snowplough interface is connected to the vehicle interface at least by a pitch rotational degree of freedom to displace the plough blade between the ploughing position and the retracted position.

Still further in accordance with the present disclosure, the pitch rotational degree of freedom between the structure of the snowplough interface and the vehicle interface comprises at least one pivot.

Still further in accordance with the present disclosure, a roll rotational degree of freedom is between the structure of the snowplough interface and the vehicle interface to allow a roll of the plough blade relative to the vehicle.

Still further in accordance with the present disclosure, at least one translational actuator is between the structure of the snowplough interface and the vehicle interface to displace the snow plough between the ploughing position and the retracted position.

Still further in accordance with the present disclosure, an output end of the at least one translational actuator is connected to the structure of the snowplough interface by a chain.

Still further in accordance with the present disclosure, the structure of the snowplough interface has a U shape, the plough blade being connected to a bottom of the U shape.

Still further in accordance with the present disclosure, the plough blade is connected to the structure of the snowplough interface at least by a yaw rotational degree of freedom to adjust an orientation of the plough blade relative to the vehicle.

Still further in accordance with the present disclosure, at least one actuator is between the plough blade and the structure to power the adjustment about the yaw rotational degree of freedom.

Still further in accordance with the present disclosure, each of the at least one actuator between the plough blade and the structure is a translational actuator.

Still further in accordance with the present disclosure, the wheel unit is connected to the vehicle interface.

Still further in accordance with the present disclosure, the wheel unit is connected to the vehicle interface by a pitch rotational degree of freedom.

Still further in accordance with the present disclosure, a suspension is between the wheel unit and the vehicle interface to act on the pitch rotational degree of freedom therebetween.

Still further in accordance with the present disclosure, the suspension comprises at least one of a biasing member and a damper.

Still further in accordance with the present disclosure, the wheel unit comprises a single rolling axle.

Still further in accordance with the present disclosure, wherein the wheel unit comprises a single one of said wheel.

Still further in accordance with the present disclosure, the single one of said wheel is positioned in a central longitudinal axis of the vehicle.

Still further in accordance with the present disclosure, the wheel unit comprises an actuated steering system.

Still further in accordance with the present disclosure, the driven steering unit comprises a translational actuator.

Still further in accordance with the present disclosure, the at least one wheel is a tire on a hub.

In accordance with the present disclosure, there is provided an assembly comprising: a vehicle; the snowplough system as described above, the snowplough system releasably anchored to the front end of the vehicle.

DETAILED DESCRIPTION

Figure 1:
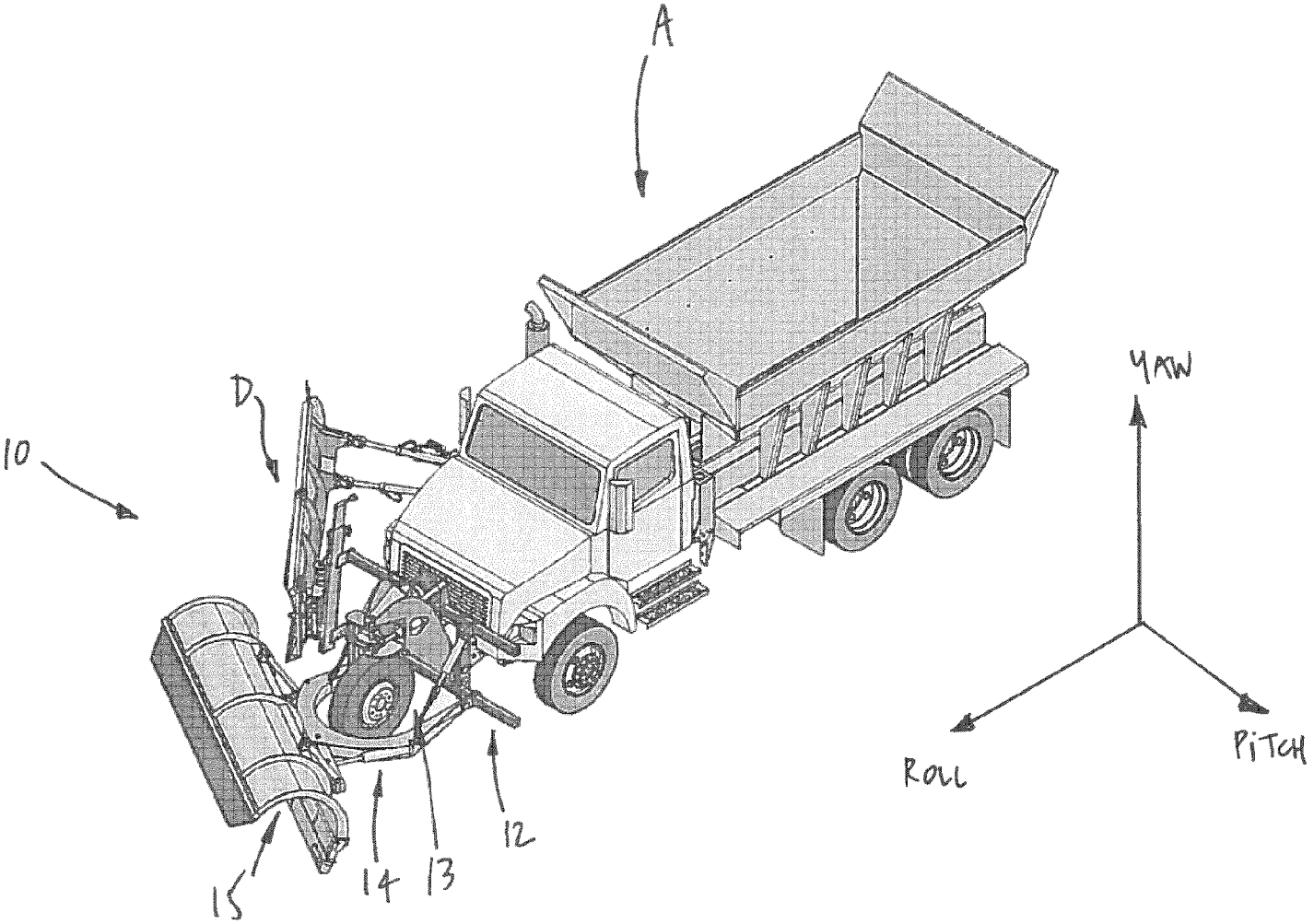
FIG. 1 is a perspective view of a vehicle equipped with a wheeled snowplough system in accordance with the present disclosure.

Referring to the drawings and more particularly to FIG. 1, a wheeled snowplough system is generally shown at 10, as being mounted to a front-end of a vehicle A, the vehicle A being a truck in the illustrated embodiment. The expression snowplough can also be spelled "snowplow", "snow plough", "snow plow", but for consistency "snowplough" will be used throughout the present disclosure. The wheeled snowplough system 10 comprises a vehicle interface 12, a wheel unit 13, a snowplough interface 14 and a snowplough unit 15. For reference, the system 10 has a pitch, roll and yaw reference axes, illustrated approximately in FIG. 1. The pitch, roll and yaw reference axes of the system 10 may be similar to that of the vehicle A with corresponding axes generally extending in the same direction, however, the corresponding axes may not be precisely parallel. In the following paragraphs, reference to pitch, roll and yaw refers to that of the system 10 and not to that of the vehicle A, unless stated otherwise.

The vehicle interface 12 is used as the interface between the wheeled snowplough system 10 and a plough attachment frame B of the vehicle, the frame B being adapted to support the wheeled snowplough system 10. Moreover, the vehicle interface 12 defines a frame for supporting the wheel unit 13, the snowplough interface 14 and the snowplough unit 15.

The wheel unit 13 is provided to support a portion of the weight of the wheeled snowplough system 10 on the road, thereby alleviating the weight on the vehicle A, and allowing to increase the vehicle payload.

The snowplough interface 14 is used to support the snowplough unit 15 and to displace same to have a proper attack orientation. Moreover, the snowplough interface 14 is responsible for raising the snowplough unit 15 from a ploughing position, for the snowplough unit 15 to plough away snow, to a retracted position, in which the snowplough unit 15 is raised from contact with the road. The snowplough interface 14 may also provide some roll capability to the snowplough blade 15 relative to the vehicle A.

The snowplough unit 15 provides the snowplough blade, i.e. the tool that will perform the snowploughing action.

Figure 2:
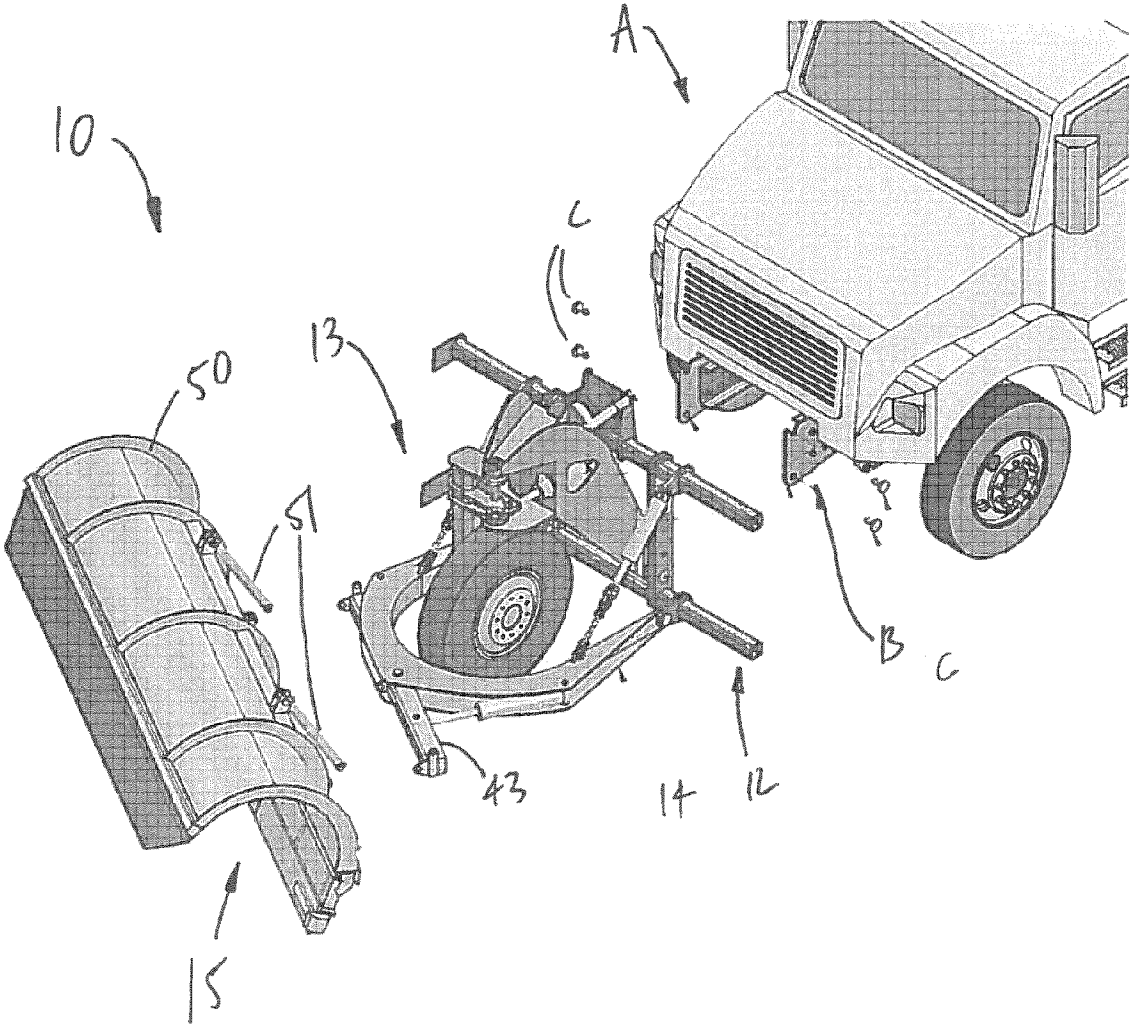
FIG. 2 is an assembly view of the wheeled snowplough system of the present disclosure.
Figure 3:
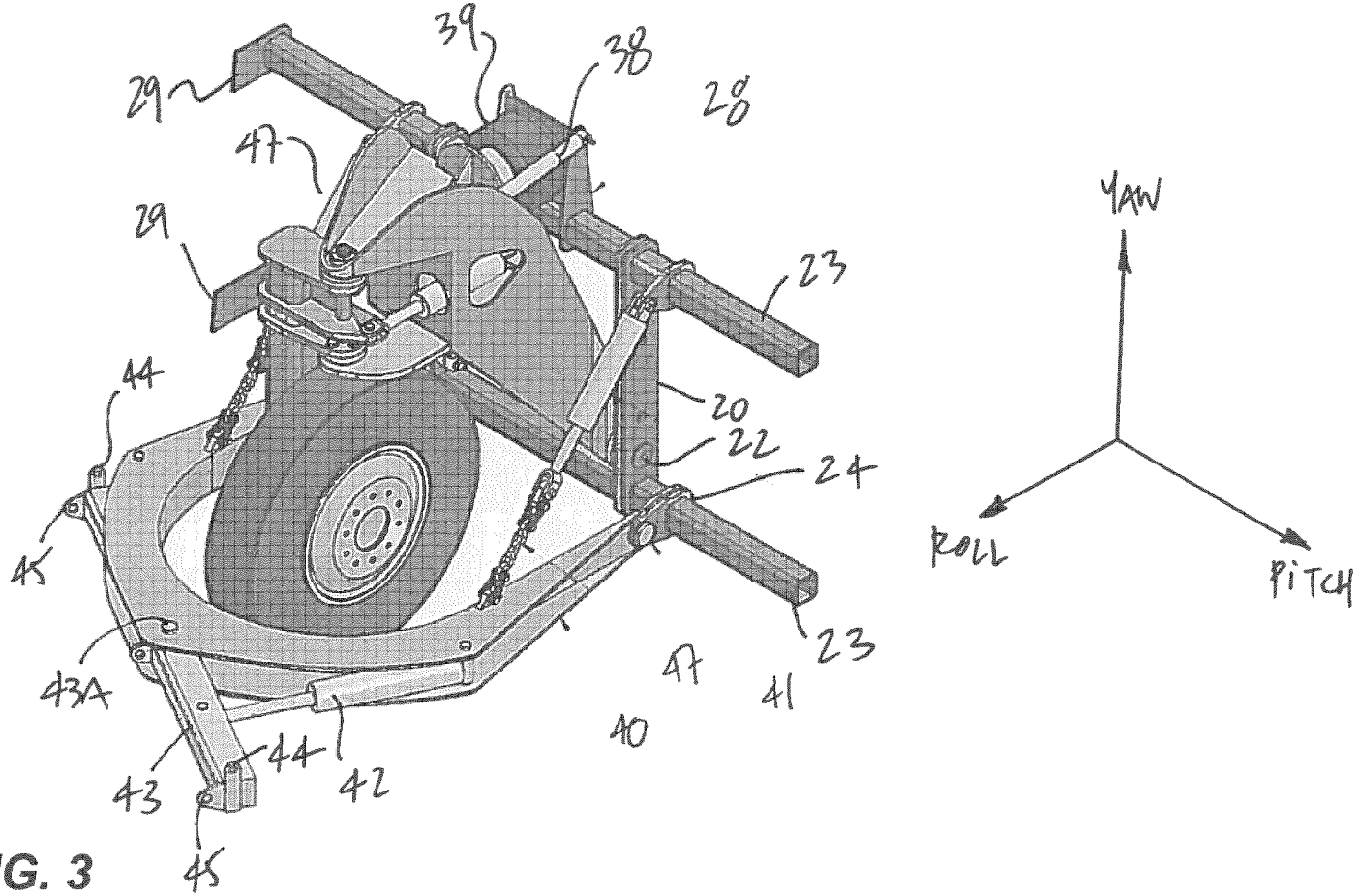
FIG. 3 is a perspective view of the wheeled snowplough system of FIG. 2, without a snow blade.
Figure 4:
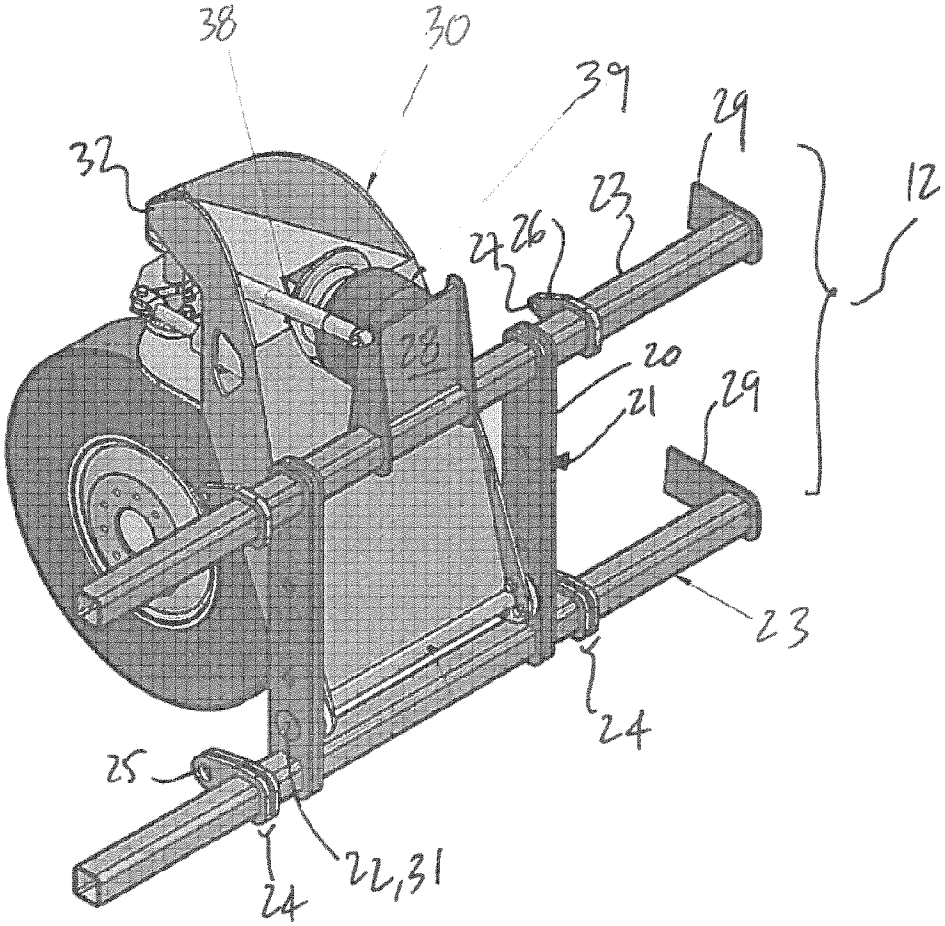
FIG. 4 is a perspective view of the wheeled snowplough system of FIG. 3, from a rear standpoint.

Referring concurrently to FIGS. 2, 3 and 4, one possible configuration of the vehicle interface 12 is shown in greater detail. The vehicle interface 12 comprises a pair of columns 20. The columns 20 may each be formed by a pair of elongated bars or plates with a gap 21 formed therebetween, for each of the columns 20. The gap 21 is sized so as to receive connection hooks of the plough attachment frame B of the vehicle A as shown in FIG. 2, while limiting lateral play. The columns 20 have pinholes 22, whereby pegs C in the frame B may lock the vehicle interface 12 and thus the wheeled snowplough system 10 to the vehicle A. The pegs C must thus be provided with adequate locking means so as not to be dislodged accidentally from interconnection between the vehicle interface 12 and the frame B. The columns 20 with pegs C and the frame B with connection hooks is one of multiple possible configurations considered for realisably anchoring the snowplough system 10 to the vehicle A.

Still referring to FIGS. 2-4, horizontal beams 23 are interconnected to the columns 20. The beams 23 are shown as being square-section tubes, although other types of beams may be used, including beams of tubular and non-tubular sections. A bottom one of the beams 23 comprises sets of flanges 24. The sets of flanges 24 are pairs of flanges with a gap therebetween and with pinholes 25. The flanges 24 will be used for the connection of the snowplough interface 14 to the vehicle interface 12 in a manner described hereinafter. Flanges 26 are on an upper one of the beams 23, and also have pin holes 27. The flanges 26 will also be used for the connection of the snowplough interface 14 component to the vehicle interface 12. A bracket 28 is located on the upper beam 23 and projects upwardly therefrom. The bracket 28 is used to as an abutment and connection member for components of the wheel unit 13 as described hereinafter. Connector plates 29 are located at the right ends of the beams 23. The connector plates 29 are used as attachments for the lateral plough unit D, as shown in FIGS. 1 and 2. It is considered to also equip the left ends of the beams 23 with such connector plates if a lateral plough unit such as D is to be used on the left side of the vehicle A.

In the illustrated embodiment, the various components of the vehicle interface 12 may be welded and/or machined into an integral unit. The vehicle interface 12 will be subjected to important loads and exposed to abrasive and corrosive substances, whereby the choice of material must take such factors in consideration.

Figure 5:
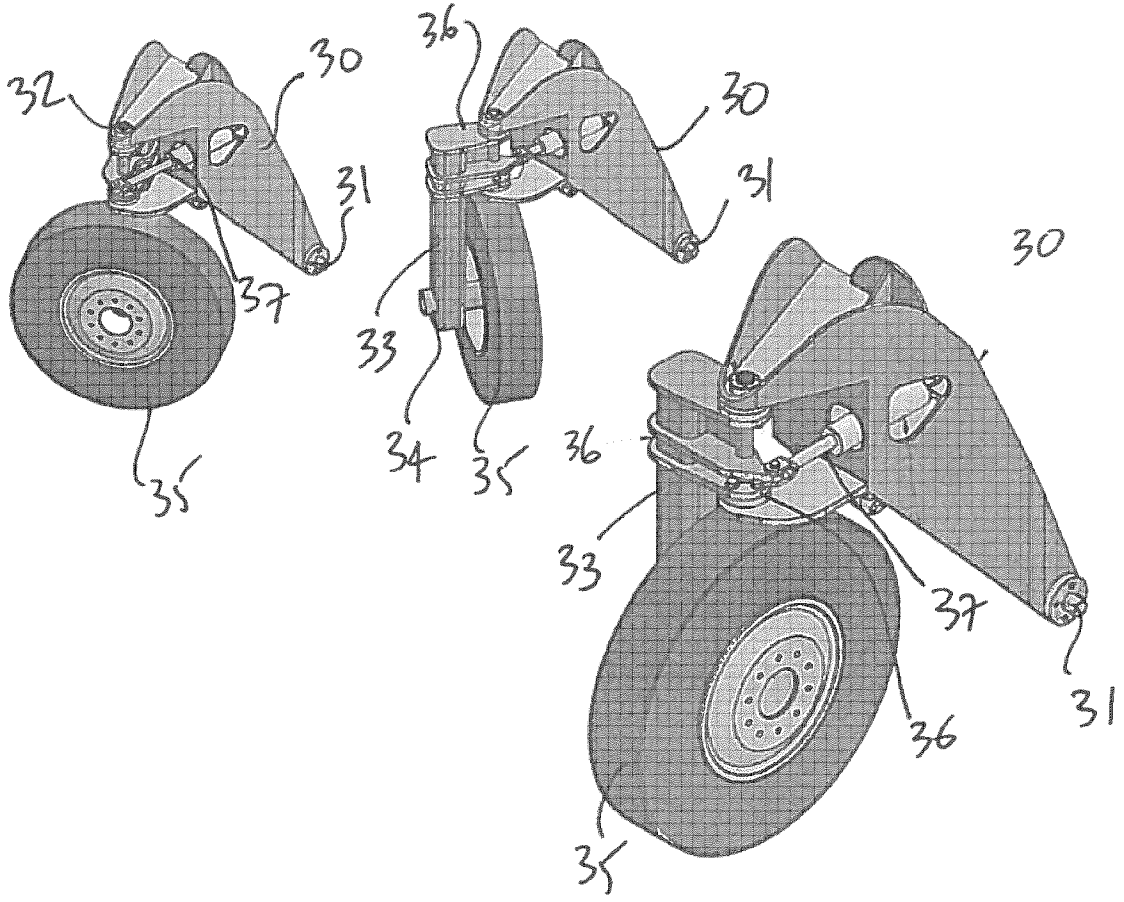
FIG. 5 is a perspective view of a wheel unit of the wheeled snowplough system of FIG. 2.

Referring internally to FIGS. 3, 4 and 5, the wheel unit 13 is shown in greater detail. The wheel unit 13 is rotatably connected to the vehicle interface 12 for controlling a steering orientation of a wheel thereof. More specifically, the wheel unit 13 has a wheel support 30 that is pivotally connected to the columns 20 of the vehicle interface 12, by a pitch rotational degree of freedom (DOF) (i.e., a rotational DOF whose rotational axis is the pitch axis of the system 10). Pivots 31 are provided at the base of the wheel support 30 to allow this pivoting movement relative to the columns 20, about a generally horizontal axis (the pitch axis). Hence, the pivot mount of the wheel support 30 to the vehicle interface 12 allows vertical adjustment of the position of a wheel of the wheel unit 13.

The wheel support 30 consists of various structural members such as plates arranged so as to define a bracket 32. The bracket 32 has a C-like shape, by which a top end of spindle 33 is pivotally connected to the wheel support 30, i.e., a pitch DOF is provided. The spindle 33 has at its bottom end a hub 34 by which a wheel 35 is rotatably mounted to the spindle 33. Although a single wheel 35 is shown, a wheel set could be used as well (as in landing gears of aircraft). Moreover, the single wheel 35 may be of the type featuring a hub and a tire, as opposed to a caster, considering that the wheel 35 will bear an important part of the load of the cantilevered plough blade 50. The wheel 35 (or wheelset) has a single rolling axle, and is aligned along the longitudinal central axis of the vehicle.

A connector member 36 projects laterally from the spindle 33 and is pivotally mounted to the bracket 32, for rotation about a generally vertical axis (i.e., an axis lying in a substantially vertical plane). Therefore, as the spindle 33 may rotate about the generally vertical axis of interconnection between the connector member 36 and the wheel support 30 (yaw axis), a steering orientation of the wheel 35 may be adjusted. For this purpose, a control arm 37 is connected to the connector member 36. The control arm 37 is connected to a portion of the connector member 36 that is eccentrically located relative to the pivot axis of the spindle 33, whereby a change of length of the control arm 37 will result in a steering of the wheel 35. Other configurations are considered for the wheel support 30 and spindle 33, including using multiple wheels 35, on one or more spindles 33, etc. The control arm 37 is a translational actuator, such as a linear actuator or cylinder.

Referring to FIGS. 2, 3 and 4, the wheel unit 13 has a suspension to ensure that the wheel 35 remains in contact with the road, while absorbing shocks. Firstly, a cylinder 38 has a first end connected to the wheel support 30, and a second end mounted to the bracket 28. The cylinder 38 may act as a damper. An air bladder 39 is also provided between the bracket 28 and the wheel support 30, and acts as the spring component of the suspension, biasing the wheel support 30 away from the bracket 28 and hence biasing the wheel 35 against the road. Therefore, any pivoting movement of the wheel support 30 relative to the vehicle interface 12 will be subjected to the combined action of the cylinder 38 and the air bladder 39. Other configurations and components may be used, including other types of springs, multiple dampers, etc. The suspension components may be located elsewhere, such as at on the pivot axis between the bracket 28 and the wheel support 30, on the spindle 33, etc. Although the wheel unit 13 is illustrated as having a single wheel, it is considered to equip the wheel unit 13 with more than one wheel.

Figure 6:
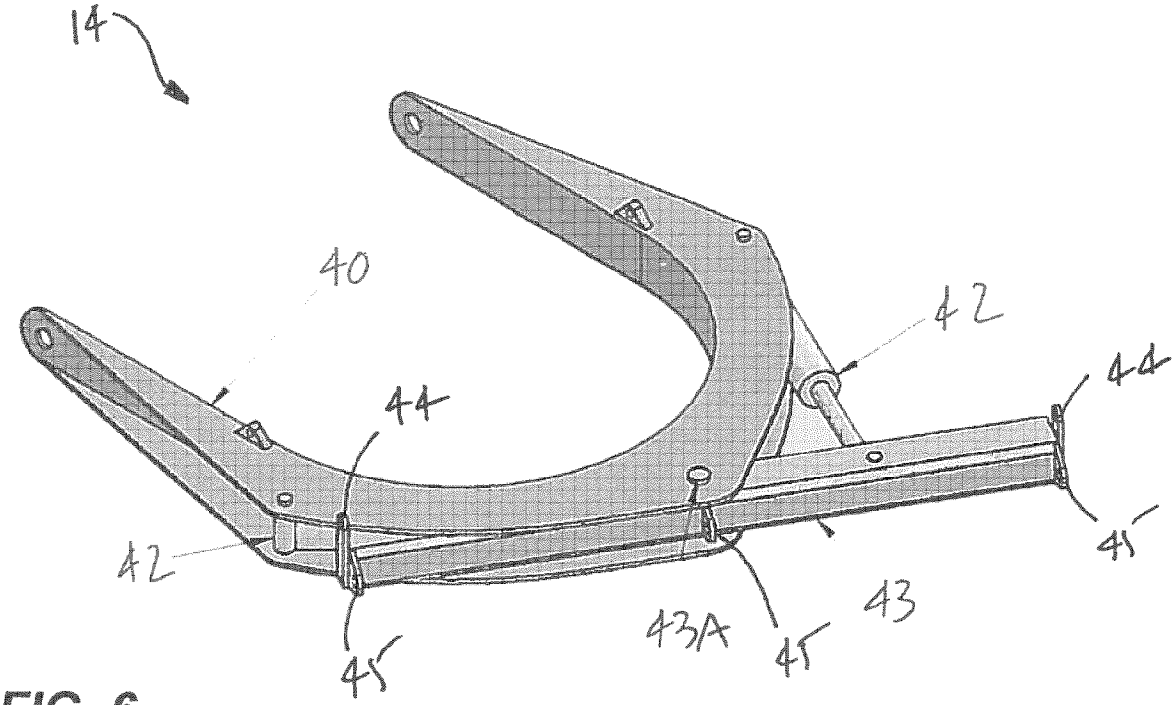
FIG. 6 is a perspective view of a snowplough interface of the wheeled snowplough system of FIG. 2.

Referring to FIG. 6, the snowplough interface 14 is shown having a U-shaped frame 40 or like structure. The U-shaped frame 40 is connected as opposed ends to the vehicle interface 12. In the illustrated embodiment, ends of the U-shaped frame 40 are received in the sets of flanges 24, with pivots 41 inserted in the pinholes 25, whereby the U-shaped frame 40 may pivot about a generally horizontal axis (relative to the vehicle A being horizontal), i.e., a pitch rotational degree of freedom is provided between the frame 40 and the vehicle interface 12. It is considered to provide a permanent pivot to ensure that the snowplough interface 14 remains anchored to the vehicle interface 12, and to avoid accidental disconnection of the snowplough interface 14 from the vehicle interface 12. It is also contemplated to have a different configuration, such as with a four-bar mechanism, and a translational DOF between the snowplough interface 14 and the vehicle interface 12.

The U-shaped frame 40 may have a C-like shaped section, thereby defining a channel. A pair of cylinders 42 may be partly received in this channel and may act jointly to actuate a pivoting movement with a plough blade support 43. The plough blade support 43 is an elongated member pivotally connected at 43A to the U-shaped frame 40. Accordingly, the action of the cylinders 42 will adjust an orientation of the plough blade support 43 about a rotational axis that is generally vertical (i.e., a yaw DOF is provided), to adjust an attack orientation of the plough blade, as described hereinafter. Ears 44 and flanges 45 are positioned at various locations on the plough blade support 43 for connection of the plough blade to the plough blade support 43, in the manner described hereinafter.

Referring to FIGS. 1 to 3, cylinders 47 are positioned on opposite sides of the U-shaped frame 40 and are used to control the movement of the snowplough unit 15 between the ploughing position and the retracted position. The cylinders 47 each have one end connected to the flanges 26 on the upper beam 23. An opposite end of the cylinders 47 is connected to brackets on the U-shaped frame 40, hence raising or lowering the U-shaped frame 40 by expanding or contracting. In an embodiment, it is considered to use chains on the rod end of the cylinders 47.

Figure 7:
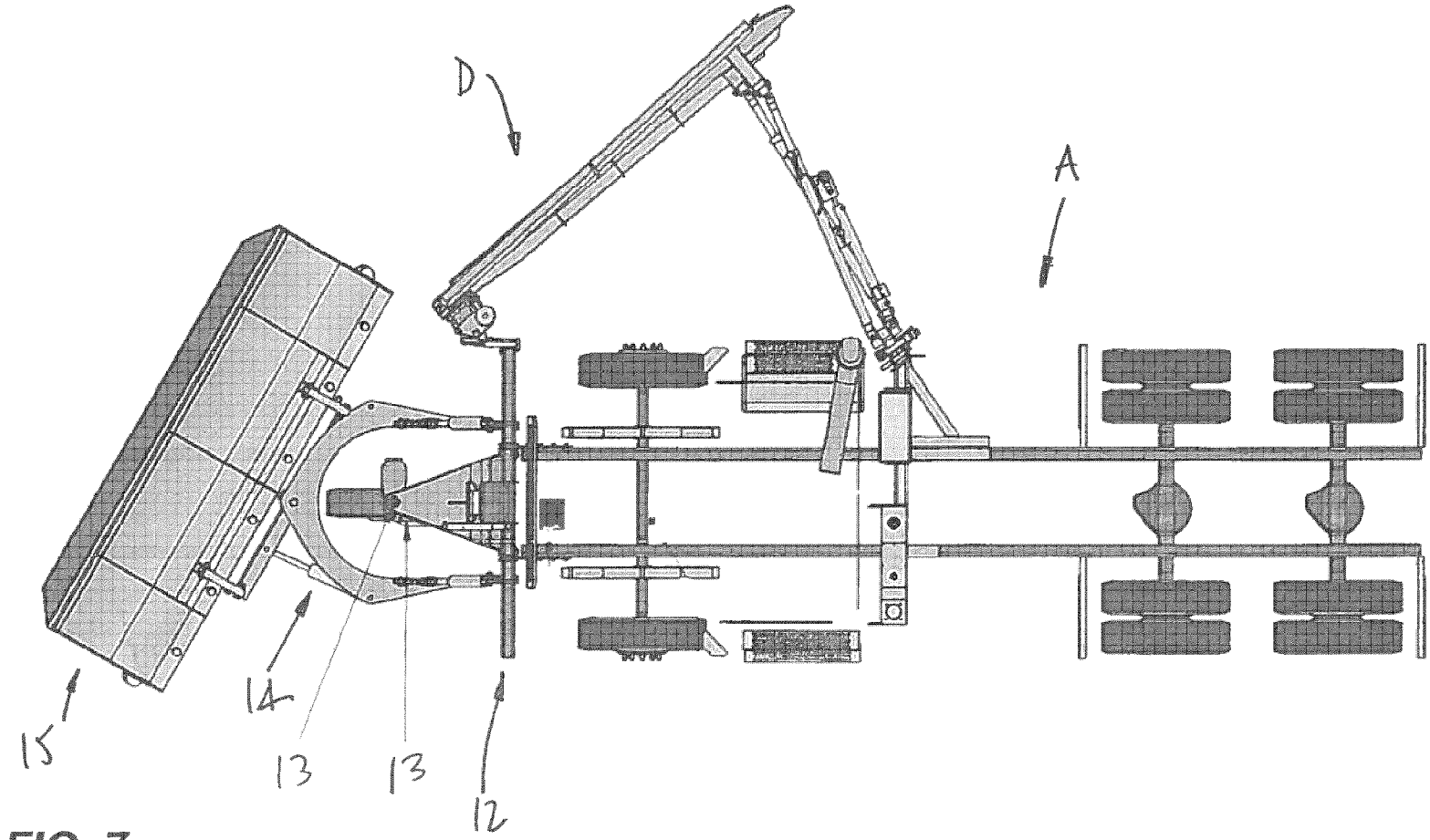
FIG. 7 is a top plan view of the wheeled snowplough system of FIG. 2 relative to a vehicle frame.

Referring to FIGS. 6 and 7, plough blade 50 has having a conventional concave shape (e.g., generally quarter cylindrical in shape). Struts 51 interconnect the plough blade 50 to the ears 44 of the plough blade support 43. Appropriate connectors are located on the convex surface of the plough blade 50 to be connected to the flanges 45 on the plough blade support 43. The plough blade 50 may have other configurations as well, for instance with planar sheets as opposed to a concave shape, multiple panels, etc.

The wheeled snowplough system 10 of FIGS. 1-7 is shown having a plurality of cylinders driving movements of components, such as cylinders 42 and 47. A hydraulic system with all appropriate components may be used, along with the appropriate interfaces for a driver in the truck cabin to adjust the attack orientation of the plough blade 50, or to raise or lower the plough blade 50. It is also considered to use linear actuators, pneumatic cylinders, etc.

The control arm 37 must control the steering orientation of the wheel 35. In an embodiment, the control arm 37 has a controller that is connected to the electronic system of the truck, so as to obtain a steering output from the truck steering system. The controller of the control arm 37 may adjust its steering orientation proportionally to that of the truck steering system. Considering that some trucks may not currently have an electronic steering system, it is contemplated to monitor the steering angle of the vehicle wheels (e.g., by way of sensors), among other possibilities, to adjust an orientation of the wheel 35 as a function of the steering of the vehicle A. The orientation of the wheel 35 may also be monitored by sensors for instance on the connector member 36.

The positioning of the wheel 35—in front of the front axle of the vehicle and in the wake of the plough blade 50—is such that the weight of the cantilevered snowplough unit 15 is spread between the wheel 35 and the front axle of the vehicle A. When the snowplough unit 15 is raised, the weight thereof is on the vehicle interface 12. As the vehicle interface 12 is between the wheel 35 and the front axle of the vehicle A, the wheel 35 will take on a part of the load, thereby lessening the load on the front axle A of the vehicle.

It is also considered to connect the wheel unit 13 to the snowplough interface 14 instead or in addition to the vehicle interface 12.

Figure 8:
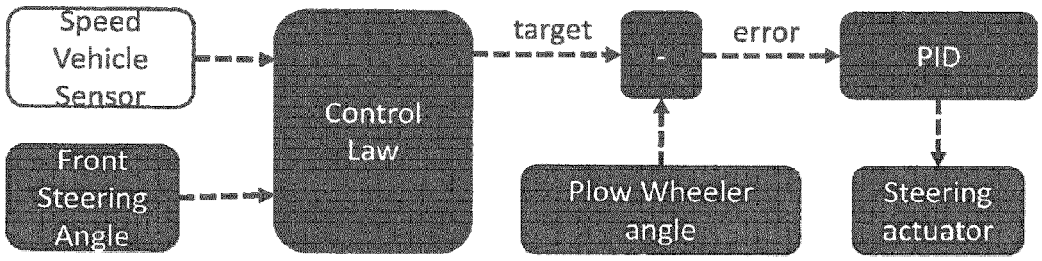
FIG. 8 is a block diagram of a steering controller of the wheeled snowplough system of FIG. 2.
Figure 9:
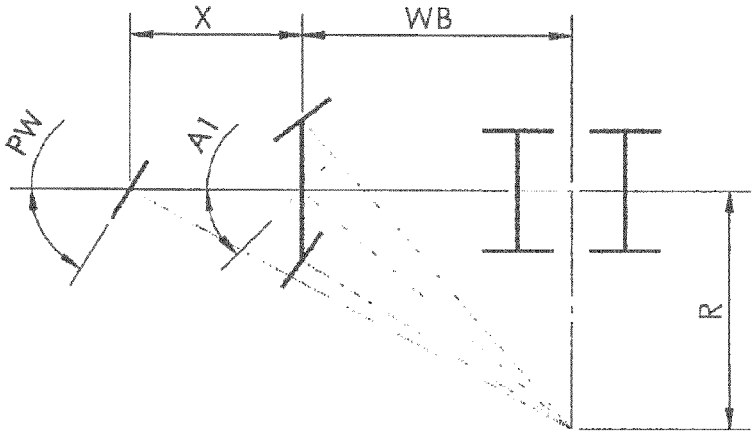
FIG. 9 is a schematic of steering law control for the wheeled snowplough system of FIG. 2.

FIG. 8 shows a block diagram of a wheel steering controller, for steering the wheel 35. The steering angle of the wheel 35, as shown in FIG. 9, is estimated based on Ackerman geometry. The vehicle speed could be introduced as an input parameter to discriminate between low and high speed law control. The high speed law control is based on tuning coefficients of a PID controller.

Figure 10:
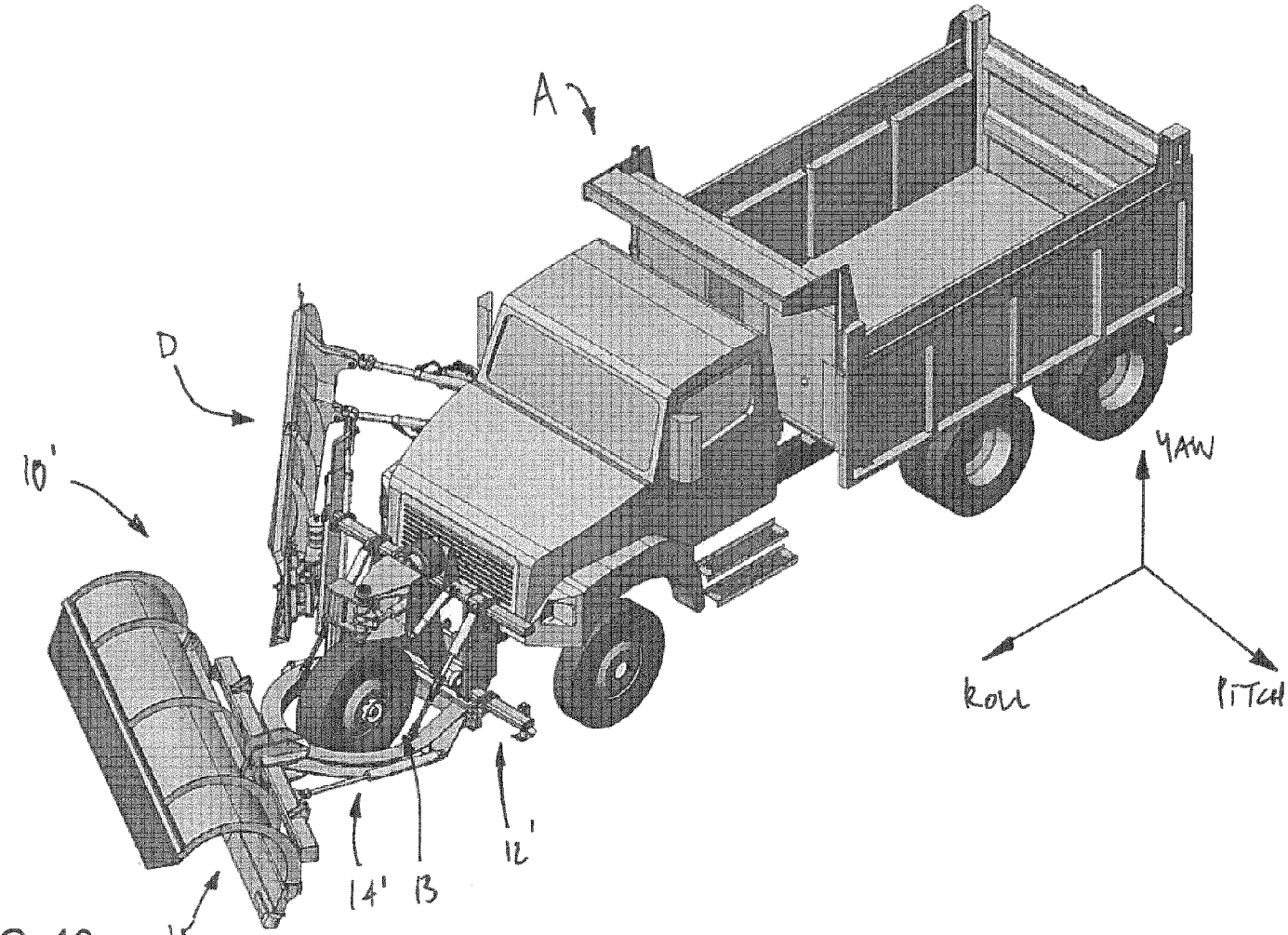
FIG. 10 is a perspective view of a vehicle equipped with a wheeled snowplough system in accordance with another embodiment of the present disclosure.
Figure 11:
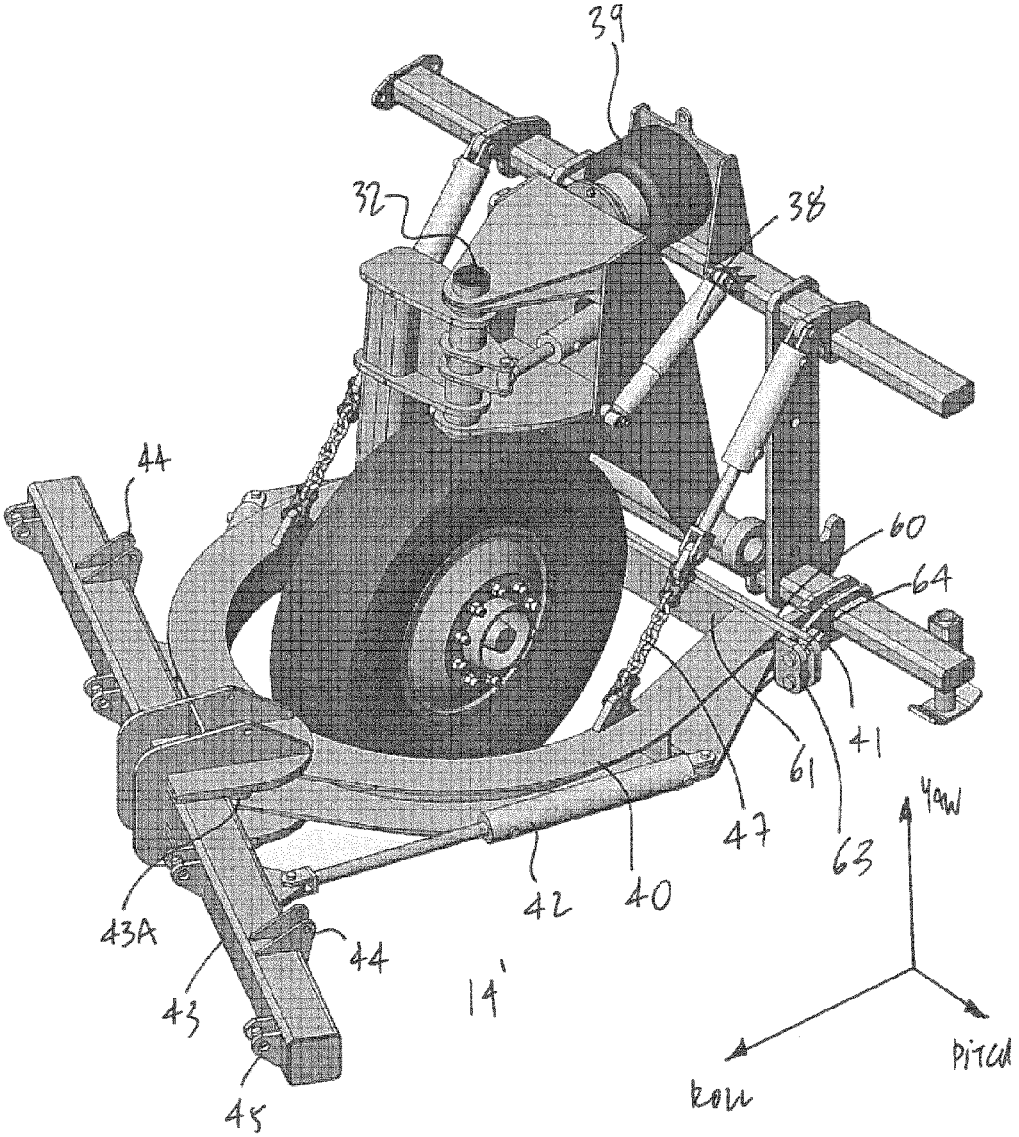
FIG. 11 is a front perspective view of the wheeled snowplough system of FIG. 10.
Figure 12:
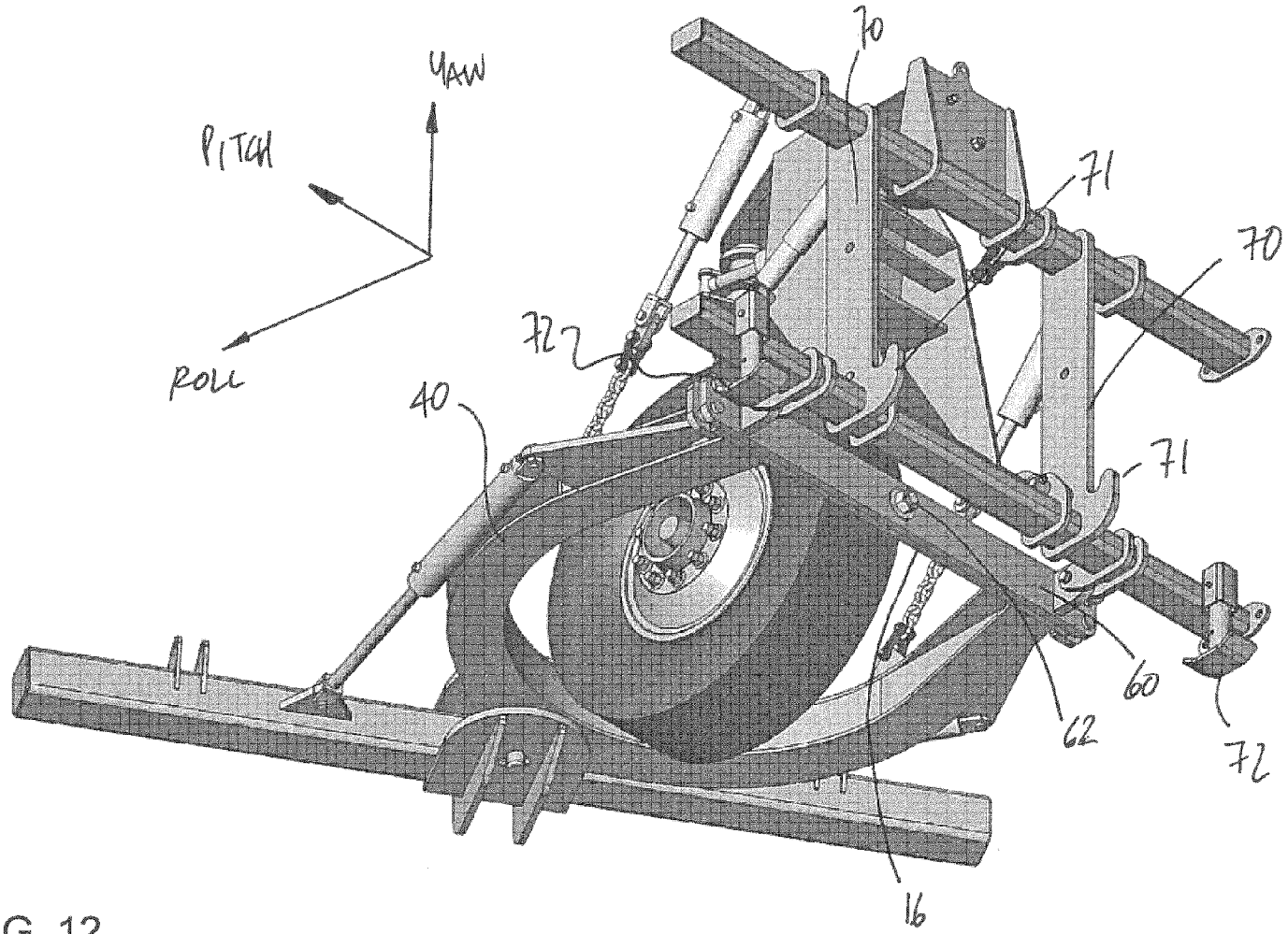
FIG. 12 is a rear perspective view of the wheeled snowplough system of FIG. 10.

Referring to FIGS. 10-12, another embodiment of the wheeled snowplough system is shown at 10', and comprises numerous identical or similar components as the system 10 of FIGS. 1-7, whereby like components will bear like reference numerals. There are differences in the systems 10 and 10' at the vehicle interface 12' and at the snowplough interface 14'.

Referring to FIGS. 11 and 12, a first difference is the presence of a roll rotational DOF in the snowplough interface 14' to allow roll of the snowplough unit 15 relative to the vehicle A. In the illustrated embodiment, the roll DOF is enabled by the presence of a pair of beams 60 and 61 pivotally connected by pivot joint 62 (FIG. 12). A constraining mechanism formed of brake pads 63 and fasteners 64 could oppose an adjustable amount of friction to limit free movement of the beam 61 relative to the beam 60.

A second difference is the configuration of the vehicle interface 12', having a pair of single columns 70 instead of doubled up columns as in the vehicle interface 12—it is the vehicle frame attachment that has the doubled up columns instead. A hook portion 71 at a bottom is provided to clamp the vehicle interface 12' to the vehicle attachment frame. Legs 72, adjustable in the yaw direction, can act like stands when the system 10 is not used.

The invention claimed is:

1. A snowplough system for being releasably anchored to a front end of a vehicle, the snowplough system comprising:

a plough blade;

a vehicle interface adapted to be releasably anchored to a frame of the vehicle, the vehicle interface having anchor means for immovably fixing the vehicle interface to the frame of the vehicle when anchored thereto;

a snowplough interface operatively connected to the vehicle interface and comprising a structure supporting the plough blade, the structure being movable to displace the plough blade between a ploughing position and a retracted position; and a wheel unit connected to and supported by the vehicle interface, and comprising at least one wheel located in front of a front axle of the vehicle, to support part of the weight of the plough blade when in the retracted position, such that the weight of the structure and of the plough blade is configured to be spread at least to the wheel unit and to the front axle of the vehicle via the vehicle interface.

2. The snowplough system according to claim 1, wherein the structure of the snowplough interface is connected to the vehicle interface at least by a pitch rotational degree of freedom to displace the plough blade between the ploughing position and the retracted position.

3. The snowplough system according to claim 2, wherein the pitch rotational degree of freedom between the structure of the snowplough interface and the vehicle interface comprises at least one pivot.

4. The snowplough system according to claim 1, further comprising a roll rotational degree of freedom between the structure of the snowplough interface and the vehicle interface to allow a roll of the plough blade relative to the vehicle.

5. The snowplough system according to claim 2, further comprising at least one translational actuator between the structure of the snowplough interface and the vehicle interface to displace the snow plough between the ploughing position and the retracted position, the at least one translational actuator being connected to the vehicle interface above an axis of the pitch rotational degree of freedom.

6. The snowplough system according to claim 5, wherein an output end of the at least one translational actuator is connected to the structure of the snowplough interface by a chain.

7. The snowplough system according to claim 1, wherein the structure of the snowplough interface has a U shape, the plough blade being connected to a bottom of the U shape.

8. The snowplough system according to claim 1, wherein the plough blade is connected to the structure of the snowplough interface at least by a yaw rotational degree of freedom to adjust an orientation of the plough blade relative to the vehicle.

9. The snowplough system according to claim 8, further comprising at least one actuator between the plough blade and the structure to power the adjustment about the yaw rotational degree of freedom.

10. The snowplough system according to claim 9, wherein each of the at least one actuator between the plough blade and the structure is a translational actuator.

11. The snowplough system according to claim 1, wherein the wheel unit is connected to a lower end of the vehicle interface by a pitch rotational degree of freedom.

12. The snowplough system according to claim 11, further comprising a suspension between the wheel unit and an upper end of the vehicle interface to act on the pitch rotational degree of freedom therebetween.

13. The snowplough system according to claim 12, wherein the suspension comprising at least one of a biasing member and a damper.

14. The snowplough system according to claim 1, wherein the wheel unit comprises a single rolling axle.

15. The snowplough system according to claim 1, wherein the wheel unit comprises a single one of said wheel.

16. The snowplough system according claim 15, wherein the single one of said wheel is positioned in a central longitudinal axis of the vehicle.

17. The snowplough system according to claim 1, wherein the wheel unit comprises an actuated steering system for displacing the wheel about a yaw rotational degree of freedom.

18. The snowplough system according to claim 17, wherein the actuated steering unit comprises a translational actuator.

19. An assembly comprising:

a vehicle;

the snowplough system according to claim 1, the snowplough system releasably anchored to the front end of the vehicle.

20. The snowplough system according to claim 1, further comprising a lateral plough blade connected to and supported by the vehicle interface.

* * * * *